United States Patent [19]

Rooney

[11] Patent Number: 4,845,807

[45] Date of Patent: Jul. 11, 1989

[54] FLASHING BRACKET

[75] Inventor: Dennis J. Rooney, Sterling, Ill.

[73] Assignee: National Manufacturing Co., Sterling, Ill.

[21] Appl. No.: 242,630

[22] Filed: Sep. 12, 1988

[51] Int. Cl.[4] ..... E05D 15/06

[52] U.S. Cl. ..... 16/94 R; 16/95 R; 248/222.2

[58] Field of Search ..... 16/87.4 R, 94 R, 94 D, 16/95 R, 95 D, 95 DW, 95 W; 248/222.2

[56] References Cited

U.S. PATENT DOCUMENTS

| | | | |
|---|---|---|---|
| 1,036,589 | 8/1912 | Eggleston | 16/94 R X |
| 3,278,980 | 10/1966 | Donovan | 16/87.4 R X |
| 3,636,588 | 1/1972 | Ferris | 16/94 R |
| 3,983,600 | 10/1976 | Smith | 16/94 R |
| 4,424,605 | 1/1984 | Squires et al. | 16/94 R |

*Primary Examiner*—Fred A. Silverberg

*Attorney, Agent, or Firm*—Edmond T. Patnaude

[57] ABSTRACT

A hanger bracket for the split rail of a horizontal sliding door assembly is provided with an aperture into which a dependent tab on a flashing support bracket extends, and a resilient tongue on the flashing support bracket fits under the hanger bracket to removably attach the flashing support bracket to the hanger bracket.

8 Claims, 2 Drawing Sheets

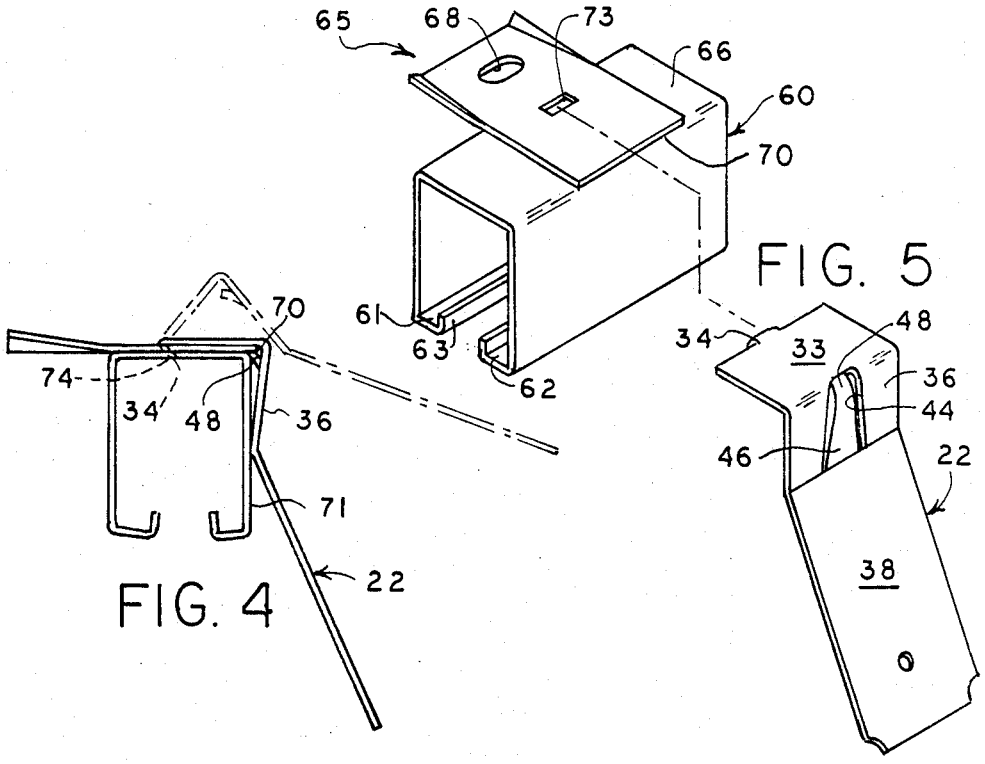
FIG. 5
FIG. 4
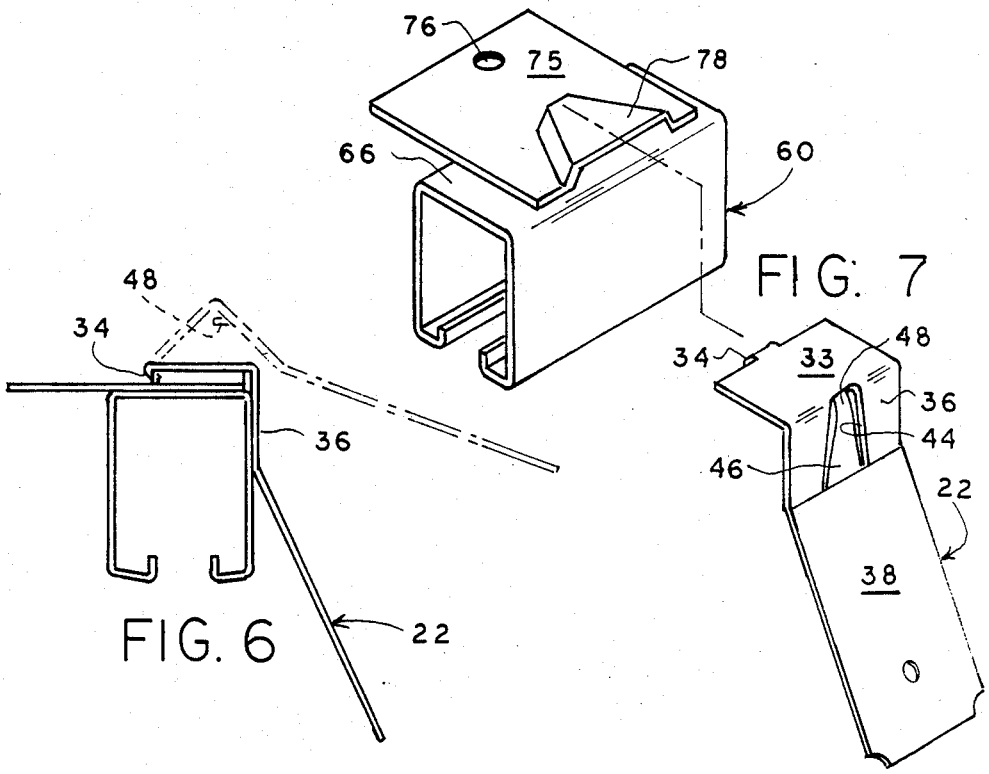
FIG. 7
FIG. 6

FLASHING BRACKET

The present invention relates in general to a system for mounting the support rail and associated cover or flashing for a sliding door, and it relates in particular to a new and improved mounting bracket assembly in which a flashing support bracket is removably and securely affixed to a rail support bracket solely by means of a snap fitting.

BACKGROUND OF THE INVENTION

Horizontally sliding doors of the type commonly used on farm and industrial buildings are hung from overhead split rails which are mounted to the wall above the associated doorway. Ordinarily the rail is attached to the building by means of a plurality of mounting brackets which are affixed to the rail by welding and which include extensions to which a cover or flashing is mounted to protect the rail and the associated trolleys from the elements.

In the past it has been the usual practice in the industry to assemble the mounting brackets and the flashing brackets to the rail at the factory to facilitate installation at the building site. However, because of the usual construction of the flashing brackets, they being relatively long, shipping of the assembled rails was difficult and expensive and often time resulted in damage to the flashing brackets.

U.S. Pat. No 4,424,605 describes one attempted solution to this problem wherein the flashing brackets are provided with extending tabs which are fitted between the top of the rail and an overlying portion of the rail support brackets. That construction enables the shipping of the rails and brackets in a disassembled condition, but it is necessary to hammer the bracket into place which sometimes damages the brackets. Moreover, once assembled, the flashing brackets cannot be removed from the associated rail assembly. It has also been suggested to screw or bolt separate flashing brackets to the rail or rail support brackets at the site of the installation, but that substantially increases the time and cost of the installation.

SUMMARY OF THE INVENTION

Briefly, there is provided in accordance with the present invention a new and improved rail support and flashing bracket assembly for use with a horizontal sliding door of the type commonly used in barns, pole buildings and the like. With this system the rail is first mounted above the doorway by means of a plurality of spaced-apart support brackets, and then a plurality of flashing brackets are respectively snap-fitted to the support brackets without the use of any tools. Subsequently, the flashing is mounted to the flashing support brackets over the rail to protect the rail and the upper part of the associated door from the elements.

Should it become necessary to replace any of the flashing brackets it is only necessary to remove the flashing and snap the flashing brackets, which are to be replaced, away from the associated support brackets.

GENERAL DESCRIPTION OF THE DRAWINGS

Further objects and advantages and a better understanding of the present invention will be had by reference to the following detailed description taken in connection with the accompanying drawings wherein:

FIG. 4 is an elevational view of the rail support bracket, the rail and the flashing bracket assembly of another embodiment of the invention;

FIG. 5 is an exploded perspective view of the embodiment of the invention shown in FIG. 4;

FIG. 6 is an elevational view of still another embodiment of the invention; and FIG. 7 is an exploded perspective view of the embodiment of the invention shown in FIG. 6.

DETAILED DESCRIPTION OF A PREFERRED EMBODIMENT OF THE PRESENT INVENTION

Figure 1:
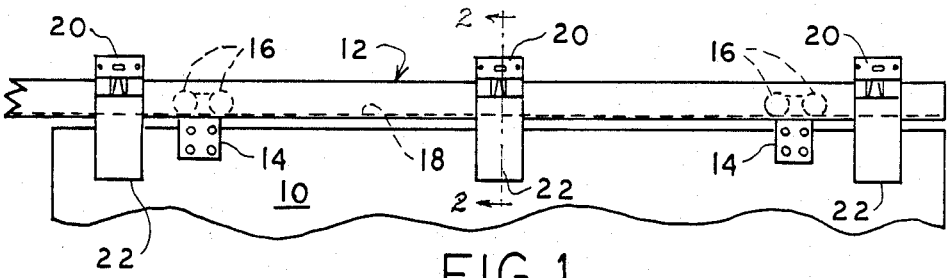
FIG. 1 is a front elevational view of a horizontal sliding door hanger assembly including the novel flashing support brackets of the present invention.

FIG. 1 shows the supporting structure of a sliding door installation with which the present invention is particularly adapted for use. As there shown, a horizontally sliding door 10 is supported from a horizontal overhead split rail 12 by means of a plurality of conventional trolley hangers 14 which are bolted to the door 10 and include a plurality of rollers 16 which are supported by track portions 18 on the rail 12. This general type of door hanger installation has been well known for a great many years and is in widespread use at the present time.

The rail 12 is mounted to an associated building above the doorway by means of a plurality of identical hanger brackets 20 which are suitably affixed as by welding to the rail 12. A plurality of flashing brackets 22 ar respectively attached to the hanger brackets 20 as more fully described hereinafter. A suitable flashing or cover member (not shown) is attached to the building and extends downwardly over and is attached to flashing brackets 22 to cover the upper portion of the door 10 and the hanger assembly to protect them from the elements.

Figure 3:
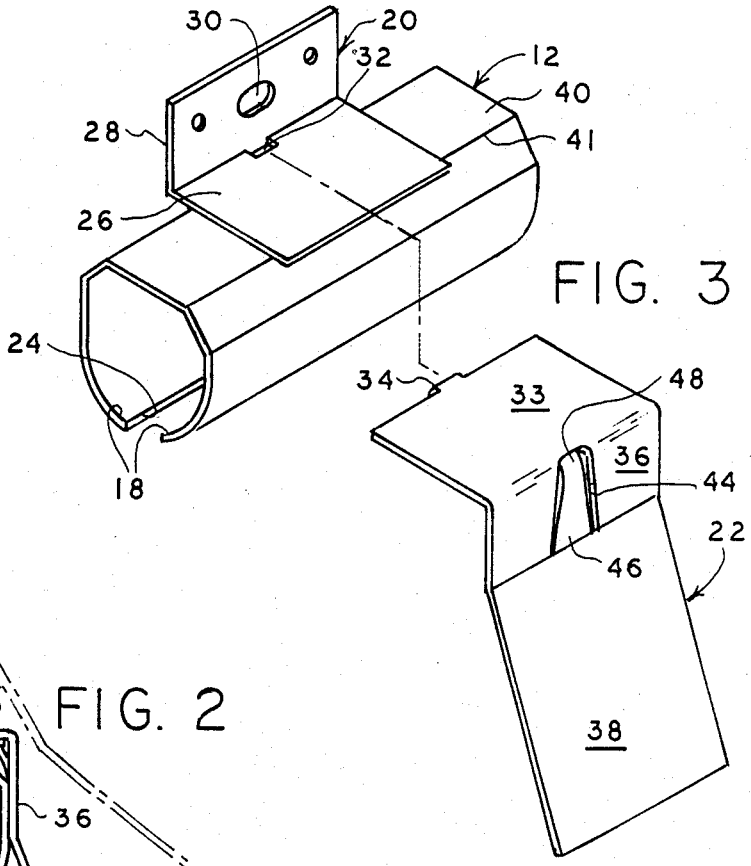
FIG. 3 is an exploded perspective view of the embodiment of the invention shown in FIG. 2.
Figure 2:
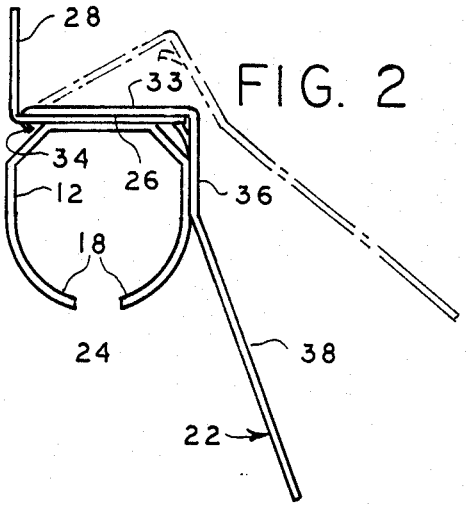
FIG. 2 is a cross-sectional view taken along the line 2—2 in FIG. 1.

Referring to FIGS. 2 and 3 there is shown a section of the rail 12 which may be seen to be in the form of a split tube having horizontally extending track sections 18 on opposite sides of a longitudinal slot 24. A hanger bracket 20, which is preferably formed of metal, is provided with a first horizontal portion 26 which extends across the top of the rail 12 and is suitably affixed thereto as by welding. An upstanding planar section 28 which extends perpendicularly to the section 26 is provided with a plurality of mounting holes 30 for receiving fastener means which attach to the mounting bracket 20 the associated building. A generally rectangular opening 32 is provided in the section 26 of the hanger bracket 20 rearwardly of the adjacent portion of the rail 12. The flashing bracket 22 is also preferably formed of metal and includes a planar, horizontal portion 33 which is adapted to rest on the portion 26 of the hanger bracket 20 and is provided with a dependent tab or hook portion 34 at the distal, rearward edge thereof which is adapted to depend into the opening 32 in the hanger bracket as shown in FIG. 2.

Adjacent to the section 33 is another planar section 36 which extends at right angles to the section 33, and below the section 36 is a planar section 38 which extends outwardly from the plane of the section 36 at an angle of about fifteen degrees as best shown in FIG. 2.

The rail 12 includes an upper planar section 40 on which rests with the section 26 of the bracket 20. The bracket section 26 extends a short distance forwardly of the front edge 41 of the rail section 40.

In order to interlock the flashing bracket 22 with the hanger bracket 20 the vertical section 36 of the flashing bracket is provided with a centrally located slot 44 in which is located an upwardly extending resilient tongue 46 having a rearwardly bent upper end potion 48 whose distal end underlies the forward edge portion of the hanger bracket section 26 to snap lock the two brackets together as the flashing bracket 22 is pivoted in a clockwise direction as shown in FIG. 2 from the position shown in phantom to the solid line position while the hook 34 depends into the aperture 32 in the hanger bracket 20. It may be seen that the flashing bracket can thus be quickly and easily assembled to the hanger bracket and the associated rail without the use of any tools.

An important feature of the flashing bracket assembly of the present invention is the fact that the flashing bracket can be readily disassembled from the hanger bracket. This can be accomplished by the use of a screwdriver or the like to press the upper end portion 48 of the tongue 46 outwardly while at the same time pivoting the flashing bracket 22 in an upward and outward direction to the position shown in phantom in FIG. 2. The hook 34 can then be readily removed from the aperture 32 to release the flashing bracket 22 from the hanger bracket 20.

Referring to FIGS. 4 and 5, there is shown a section of a split rail 60 which is in the form of a split square tube having horizontally extending track sections 61 and 62 on opposite sides of a longitudinally extending slot 63. A hanger bracket 65, which is preferably formed of metal, comprises a generally flat elongated part which is welded to the web 66 of the rail 60 and extends a substantial distance rearwardly of the rail 60 and is provided with a mounting opening 68 for receiving a suitable fastener such as a bolt or screw for attaching the bracket to the building frame above the doorway across which the door is to be mounted. As best shown in FIG. 4, the forward end of the bracket 65 is designated 70 and extends a short distance forwardly of the vertical flange portion 71 of the rail 60. An opening 73 is provided in the intermediate portion of the bracket 65 directly above an opening 74 in the web 66 of the rail 60.

In use, the rail is first mounted to the building by a plurality of the brackets 65. Then flashing brackets are snapped into place by holding each bracket in the position shown in phantom in FIG. 4 and inserting the depending tongue 34 into the holes 73 and 74. The bracket 22 is then swung downwardly, clockwise as shown in FIG. 4, which causes the upper portion 48 of the tongue 46 to snap under the forwardly extending portion 70 of the hanger bracket to lock the flashing bracket to the hanger bracket. Thereafter, the flashing members can be attached to the flashing bracket and to the building in the normal manner.

Referring to FIGS. 6 and 7, there is shown a section of the split rail 60 to the web of which a hanger bracket 75 is suitably welded. The hanger bracket 75 extends a substantial distance rearwardly of the rail 60 and is provided with a mounting opening 76 for receiving a suitable fastener which attaches the bracket 75 and the associated rail 60 to the frame of the building located above the opening to be closed by a sliding door hung from the rail 60. The hanger bracket 75 is provided with an inverted, upstanding channel section 78 which converges towards the rear to a location above the rail 60. The rearward end the channel section 78 is open and is adapted to receive the hook 34 on the flashing bracket 22 as illustrated best in FIG. 6. In order to assemble the flashing bracket 22 to the hanger bracket 75 the flashing bracket is placed in the position illustrated in phantom in FIG. 6 with the hook 34 extending into the rear open end of the channel section 78. The flashing bracket is then swung downardly (clockwise as shown in FIG. 6) to the position shown in solid lines wherein the upper end portion 48 of the tongue 46 has snapped under the bottom surface of the web portion of the channel 78 thereby to lock the flashing bracket to the hanger bracket 75.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of the present invention.

What is claimed:

1. A flashing support assembly for use with an elongate split rail from which a door is adapted to be suspended for sliding movement in the plane of the door, said flashing support assembly comprising in combination a first bracket affixed to the top of said rail and having a first mounting portion disposed above said rail for mounting said rail to a frame member located above said door, said first bracket having a second portion, said second portion being substantially flat and lying in a horizontal plane when said first bracket is mounted to said frame member, said second portion having a distal edge portion remote from said first portion and an opening therethrough disposed between said distal edge portion and said first mounting portion, a second bracket having an end portion coplanar with said second portion and resting thereon, integral hook means extending from the outer edge portion of said end portion and depending into said opening, said second bracket having an intermediate generally planar portion adjacent said end portion and being perpendicular to said end portion, integral resilient tongue means extending from said intermediate planar portion for engaging the underside of said second portion to lock said second bracket to said first bracket, and an integral flashing support portion on said second bracket adjacent said intermediate portion to which a flashing member is adapted to be mounted to cover said first and second brackets and said rail.

2. A flashing support assembly according to claim 1, wherein said opening in said second portion of said first bracket is juxtaposed with said first mounting portion.

3. A flashing support assembly according to claim 2, wherein said first mounting portion and said second portion of said first bracket are mutually perpendicular.

4. A flashing support assembly according to claim 1 wherein the distal end of said tongue is in engagement with said underside of said second portion.

5. A flashing support assembly according to claim 1 wherein said rail has an opening aligned with said opening in said second portion, and said integral hook means extends through both of said openings.

6. A flashing support assembly according to claim 1 wherein said tongue means is snapped under said second portion during assembly of said second bracket to said first bracket.

7. A flashing support assembly according to claim 6, said second portion having a raised intermediate portion spaced above coplanar side surfaces of said second portion which are adapted to engage the top of said rail, said opening being disposed in said raised intermediate portion.

8. A flashing support assembly according to claim 7, wherein said tongue means is in engagement with the underside of said raised intermediate portion.

* * * * *